US005837658A

United States Patent [19]

Stork

[11] Patent Number: 5,837,658

[45] Date of Patent: Nov. 17, 1998

[54] METAL FORMING LUBRICANT WITH DIFFERENTIAL SOLID LUBRICANTS

[76] Inventor: David J. Stork, P.O. Box 90298, Burton, Mich. 48509-0298

[21] Appl. No.: 824,320

[22] Filed: Mar. 26, 1997

[51] Int. Cl.[6] ..... C10M 137/00

[52] U.S. Cl. ..... 508/421; 508/451; 508/551; 72/42

[58] Field of Search ..... 508/551, 591, 508/421, 429, 433, 451; 72/42

[56] References Cited

U.S. PATENT DOCUMENTS

| | | | |
|---|---|---|---|
| 3,250,103 | 5/1966 | Beaubien et al. | 508/591 |
| 3,407,143 | 10/1968 | Pitchford | 508/591 |
| 3,725,274 | 4/1973 | Orozco | 508/158 |
| 3,925,214 | 12/1975 | Livingston et al. | 508/136 |
| 3,954,344 | 5/1976 | Narushima | 508/408 |
| 4,016,087 | 4/1977 | Narushima et al. | 508/472 |
| 4,140,834 | 2/1979 | Marcantonio et al. | 428/419 |
| 4,354,956 | 10/1982 | Camp . | |
| 4,390,439 | 6/1983 | Schwartz et al. . | |
| 4,474,669 | 10/1984 | Lewis et al. . | |
| 4,493,780 | 1/1985 | Schwartz et al. . | |
| 4,626,366 | 12/1986 | Frentrup et al. . | |
| 4,649,224 | 3/1987 | Panek et al. . | |
| 4,654,155 | 3/1987 | Kipp et al. . | |
| 4,665,239 | 5/1987 | Panek et al. . | |
| 4,673,518 | 6/1987 | Owens et al. . | |
| 4,688,411 | 8/1987 | Hagita et al. | 72/42 |
| 4,709,099 | 11/1987 | Panek et al. . | |
| 4,752,405 | 6/1988 | Kyle et al. . | |
| 4,797,299 | 1/1989 | Honda et al. . | |
| 5,141,659 | 8/1992 | Kashiwaya et al. | 508/591 |
| 5,340,486 | 8/1994 | Willoughby | 508/591 |
| 5,468,401 | 11/1995 | Lum et al. | 72/42 |

OTHER PUBLICATIONS

Aldrich Catolog Handbook of Fine Chemicals 1996, 1997 p. 1196.

*Primary Examiner*—Jacqueline V. Howard
*Assistant Examiner*—Cephia D. Toomer
*Attorney, Agent, or Firm*—Brooks & Kushman P.C

[57] ABSTRACT

A metal forming lubricant suitable for extreme condition use is formulated to contain one or more differential solid lubricants composed of a high melt temperature, substantially halogen-free thermoplastic in addition to conventional lubricants such as organic phosphate esters and natural and synthetic polymer waxes. The lubricants offer superior performance while resisting the tendency to foul metal working dies with gummy deposits.

19 Claims, No Drawings

METAL FORMING LUBRICANT WITH DIFFERENTIAL SOLID LUBRICANTS

TECHNICAL FIELD

The present invention pertains to metal working lubricants. More particularly, the present invention pertains to film-forming aqueous lubricant compositions containing a lubricious low melting polymer and at least one non-fluorinated high melting polymer as dispersed phases. The lubricant compositions are especially useful in metal forging and similar operations.

BACKGROUND ART

In metal forming operations, the presence of a metal working lubricant is a necessity. Without a suitable lubricant, the friction between the die and the workpiece is so great as to cause galling, scoring, and even tearing of metal. These problems are exacerbated in operations involving the formation of deep sections, for example two-piece metal beverage cans, vehicle oil pans, and particularly products of thick sections such as spark plug bases.

In the past, articles of relatively shallow section could be coated with a film of lubricating oil or a coating of a metallic soap. However, as the use of fewer drawing stages and stronger workpiece alloys pushed the processing envelope, such crude lubricants rapidly became obsolete. Further, the use of lubricating liquids and soft soap films is not conducive to the manufacturing environment, the former because of their inherent messiness, and the latter due to the softness of the films produced. Such lubricants are incapable of being used in many modern metal forming operations where surface temperatures of the dies and metal workpieces may often exceed 500° C. and may occasionally rise to temperatures of c.a. 1000° C. or higher due both to friction generated between the die and workpiece as well as the heat generated internally in the workpiece due to plastic flow of metal. At these temperatures and at the high pressures associated with metal forming, even common "high pressure lubricants" are completely ineffective.

In addition to being lubricious under extreme operating conditions, a suitable metal forming lubricant must also possess other characteristics in order that it may be successfully used in a commercial setting. For example, the lubricant must not build up on the die, otherwise "break through" or striations may be formed. In some cases, the lubricant has formed a residue of sufficient size such that the fully formed workpiece contains hollows corresponding to the built up residue, and thus produces a part which is not the mirror image of the die.

Furthermore, in most cases, it is desirable to coat the workpiece with lubricant remote from the metal forming operation. For example, metal blanks may be coated, dried, and shipped to the metal forming plant by a supplier. It is thus necessary that the lubricant coating be solid, non-tacky, and non-dusting. It is further necessary that the lubricant coating be sufficiently hard to resist damage during handling and shipping. Particularly for ferrous metal parts, the coating should be relatively non-hydroscopic and should not contain salts which promote rusting. Preparing lubricants with these often conflicting goals has proven difficult.

In U.S. Pat. No. 4,752,405 is disclosed a lubricant containing a metal soap, in this case an alkali metal salt of a $C_{12-30}$ fatty acid; a polyoxyethylene glycol having a molecular weight in the range of 1500 Da to 8000 Da; an acrylic film forming polymer; and a variety of surface active agents to promote complete mixing of the ingredients. However, while dried films of the lubricant composition exhibited improved hardness, the films were still relatively hygroscopic, absorbing only slightly less water than films containing metal soaps and metal borates, such as the films exemplified by U.S. Pat. No. 3,725,274. The water absorption is believed due to the use of polyoxyethylene glycols which themselves are considerably hydrophilic. The metal soaps and polyoxyethylene glycols, while being excellent low temperature, low pressure lubricants, lose their lubricity at higher temperatures and pressures, and are thus not suited for many modern deep drawing operations.

In U.S. Pat. No. 4,654,155 is disclosed a water-emulsifiable metal rolling lubricant containing a complex organic phosphate ester, an amine, a polyoxyalkylated oil, one or more polyoxyalkylene glycol or polyol esters, and a non-esterified polyoxyalkylene glycol. The composition was found to be highly lubricious by the three ball test. However, the composition is only suitable for operations where liquid coatings may be tolerated, such as metal rolling operations. Moreover, none of the ingredients is a high temperature, high pressure lubricant.

In U.S. Pat. No. 4,474,669 is disclosed a lubricant composition containing molybdenum disulfide, an acrylic ester, acrylic acid polymer, and a polyethylene wax in aqueous dispersion. The coating may be applied to a metal surface such as a beverage can blank and dried. Cans formed by deep drawing lubricant-coated steel compared favorably to cans formed from tin-plated steel in which the tin plating is naturally lubricious. However, the composition of U.S. Pat. No. 4,474,669 contains molybdenum disulfide (moly). Moly is widely known as a high pressure metal lubricant. However, it is very expensive and today is environmentally suspect. Thus, it must be recovered and disposed of properly or recycled, adding further to manufacturing cost.

A variety of compositions have been marketed which employ combinations of polyethylene wax with acrylic film forming polymers with and without other ingredients such as organic phosphate esters. Similar compositions containing polyvinylchloride polymers instead of polyethylene are also known, such as those disclosed in U.S. Pat. No. 3,725,274. Such compositions have been found suitable for modest drawing operations not involving either high temperature or exceptionally high pressure. Under the latter conditions, the films lose their lubricity, and galling, tearing, and other effects occur with regularity. Attempts to extend the range of such compositions by adding high temperature resistant lubricious polymers such as polytetrafluoroethylene (PTFE, Teflon®), polyvinylidene fluoride, and the like have not been successful. While lubricity is in some cases satisfactory, the fluormated polymers have been found to leave a residue which requires frequent cleaning and reconditioning of the die.

It would be desirable to provide to the metal forming industry a metal lubricant which may be used as a dry, durable coating; which is useful even at exceptionally high pressures and temperatures; which is environmentally friendly; and which leaves very little residue on metal dies. It would be further desirable to provide such a lubricant in liquid form for those applications not requiring a previously applied coating.

SUMMARY OF THE INVENTION

It has now been surprisingly discovered that excellent film forming lubricant compositions may be prepared which offer extended processing windows in the areas of high pressure and high temperature lubricity, by combining conventional lubricant additives with at least one non-halogenated thermoplastic of high melting point such that high temperature processing is possible. The subject compositions unexpectedly leave little residue on dies and other metal forming fixtures, unlike highly halogenated thermoplastics such as PTFE. Preferably, at least two thermoplastics having differing operational ranges (differential solid lubricants) are used.

DESCRIPTION OF THE PREFERRED EMBODIMENTS

The subject invention lubricant compositions comprise a series of lubricant additives, each having its own range of effectiveness. In prior art lubricating compositions, the selection of lubricating components has been made only with the ultimate use in mind. For example, organic phosphate esters and polyolefin waxes, both known lubricants, have been combined and tested at proposed operating conditions without regard to their action under at other conditions. While not wishing to be bound to any particular theory, Applicant believes that a suitable metal working lubricant must provide lubricating ability over a wide range of temperature and pressure, in addition to merely being lubricious under extreme conditions, to be a successful extreme operating condition metal forming lubricant. While theoretically one component could demonstrate lubricity under both low temperature, low pressure condition and extreme conditions, in practice, no such lubricant has been identified. Thus, it is necessary to employ a plurality of lubricants, each of which is able to lubricate over a given range of conditions while not interfering with the lubricity of other components of the composition.

Further, and again without wishing to be bound to any particular theory, Applicant believes that the lubricity of a given compound above its melting point is related to the film forming capability and/or viscosity under a given set of operating conditions. Thus, polyethylene wax, which is quite lubricious as a solid, remains lubricious at its melting point and at higher temperatures up to a point where it no longer effectively produces a coherent film. This point may be related to viscosity, with the decreasing viscosity at higher temperatures preventing efficient film formation. It is believed that this is the reason why polyethylene waxes and similar polymers are not lubricious under extreme conditions. Of course, the chemical structure of the additive and the adhesion between the additive and the metal surface which the structure causes is also a factor in lubricity. Organic phosphate esters and sulfurized oils, for example, exhibit lubricity over a wider range than similar compounds, for example the non-sulfurized oils, despite having similar melting points and viscosities. This is believed due to the greater attraction the functionalized oils have with the metal surfaces.

Natural waxes such as montan, carnauba, etc., and polyalkylene waxes such as polyethylene, low molecular weight polypropylene, copolymers of ethylene and vinylacetate, and the like, are natural candidates for lubricating films. Such waxes can be supplied in solvent form or as microemulsions and dried to form slippery coatings. Addition of extreme pressure additives such as phosphate esters and their amine and ammonium salts increases the useful range in terms of pressure. However, such lubricants provide soft films unless combined with film formers, and lose their lubricity rapidly at elevated temperatures.

Applicants have surprisingly found that metal working lubricants having a wide operating range and suitable for extreme condition operation may be prepared by employing low to moderate condition lubricants in conjunction with one or more extreme condition lubricants which comprise finely dispersed high temperature non-halogenated thermoplastics. The use of low to moderate condition lubricants such as polyoxyethylene glycols and similar polyoxyalkylene polyols and polyol esters; organic sulfates and phosphates such as polyoxyalkylene phosphates, triaryl- and tri(higher alkylene) phosphates; and natural and polymer waxes such as polyethylene and poly(ethylene/vinyl acetate) copolymer waxes enable the subject compositions to be lubricious at low temperatures, while the high temperature thermoplastics extend the lubricity to extreme conditions. The lubricity afforded by the high temperature thermoplastics is particularly surprising in view of the fact that unlike polyethylene, which has a natural slippery feel; and unlike the halogenated thermoplastics such as PTFE, the high temperature non-halogenated thermoplastics are not considered lubricious at ordinary temperatures.

The compositions of the subject invention thus comprise one or more low to moderate condition lubricants and one or more high temperature, non-halogenated polymers as a dispersed phase. The subject coating compositions, when desired for coating as a dry film, also contain minimally one film-forming polymer, and sufficient additives to stably disperse the polymer particles. The composition may further contain conventional additives such as anti-foamers, coalescing agents, anti-corrosion additives, etc. The composition may advantageously contain up to 20 weight percent of one of more dispersion stabilizing/coalescence surfactants. The compositions preferably contain no hygroscopic salts such as borates, i.e. are borate-free. In the liquid, non-coating formulations of the subject invention, the film forming polymer may be dispensed with.

By the term "low to moderate condition lubricants" is meant lubricants which are of low melting point and are suitable for use at temperatures and pressures up to and including the temperatures and pressures at which polyethylene wax is suitable. One skilled in the art has no difficulty selecting such lubricants, and may be further guided by the following listing of low to moderate condition lubricants which is exemplary and not limiting. Examples of suitable low to moderate pressure lubricants include mineral oil; lubricating oil; natural vegetable oil (triglycerides); fatty acids; alkali metal, alkaline earth metal, and other metal and also amine and ammonium salts of carboxylic acids, for example sodium and potassium palmitates, calcium linolate, zinc stearate, and the like; sulfurized and phosphatized oils; organic esters such as the α-alkylglucosides, polyoxyalkylated α-alkylglucosides; sorbitan oxyalkylates and sorbitan esters; fatty acid esters; fatty acid amides; long chain alkyl- and aralkylamines and polyamines; alkanolamines, particularly dialkanolamines and trialkanolamines; natural waxes such as montan wax, carnauba wax, mineral wax (paraffin); polyoxyalkylene sulfate and phosphate esters and other complex organic sulfates and phosphates; polyoxyethylene glycols, polyoxypropylene glycols, triand higher functional polyoxyalkylene polyols, and their amino group terminated and mono- and polyester derivatives; and polyalkylene waxes such as polyethylene homopolymer waxes and copolymer waxes prepared by block and/or random polymerization of ethylene and other unsaturated monomers such as vinylacetate, vinylchloride, acrylic acid, methacrylic acid, methylacrylate, methylmethacrylate, butylacrylate, maleic anhydride, styrene, α-methylstyrene, cyclopentene, norbornene, and the like. The polyethylene waxes have melting points in the range of 70° C. to 125° C.

Especially useful are combinations of low condition lubricants and moderate condition lubricants. Quite often, the effectiveness of the low condition lubricants overlaps or extends to the limits of the effectiveness of the moderate condition lubricants. For example, complex organic phosphates such as MASLIP® 504 are effective under low pressures and at low temperatures where polyethylene waxes are not particularly effective, yet these phosphates maintain some, although limited, effectiveness throughout most of the range at which polyethylene waxes are efficient. However, triisopropanolamine, an effective lubricant under low conditions, loses its effectiveness rapidly as the temperatures and pressures increase. Even so, lubricants such as triisopropanolamine are still useful for their low pressure, low temperature contribution as well as performing the function of solubilizing and aiding in the dispersing of other ingredients. Polyethylene wax having melting point of 125° C. or less is suitable for a low condition lubricant, for example in the amount from 2.5 to about 35 weight percent.

The critical component of the subject invention lubricants is the high temperature, non-halogenated thermoplastic polymer. By the term "non-halogenated" is meant that less than 10 mol percent of the monomers used to prepare the polymer are halogenated monomers which retain or substantially retain the halogen moiety after polymerization. Examples of halogenated monomers are vinyl chloride, vinylidene chloride, vinylidene fluoride, tetrafluoroethylene, and the like. Halogen-containing monomers such as 4,4'-dichlorodiphenylsulfone, wherein the halogen is lost during the polymerization process, is not a halogenated monomer. The term "non-halogenated" further includes halogen-free or substantially halogen-free polymers which are later halogenated, so long as not more than about 10%, preferably less than 5% by weight of the polymer consists of halogen. It is preferred that the polymers be halogen-free, i.e. contain no intentionally introduced halogen atoms.

By the term "high temperature" is meant a polymer whose melting point is considerably above that of polyethylene wax and polyethylene oligomeric polymers, i.e. significantly above 200° C., preferably above 250° C., more preferably above 300° C., yet more preferably above 350° C., and most preferably of higher melting point e.g. 400° C. or more. The polymer must, however, be thermoplastic, and must have a melting point, i.e. it must melt before any substantial decomposition takes place. Polymers whose decomposition temperatures are lower than their melting temperatures are not useful unless such polymers comprise block polymers of thermally stable blocks bonded together with one or more thermally decomposable linkages. Such polymers will have a melting point of the block polymer segments which can be identified by Differential Scanning Calorimetry (DSC) preceded by a lower decomposition temperature. However, the modulus will remain at a value far above that associated with a liquid even at the decomposition temperature, until a substantial number of linkages are broken, essentially liberating a polymer of lower melting point.

The polymers will be essentially thermoplastic, i.e. essentially linear molecules having minimal crosslinking. However, a limited amount of purposeful or unintentional crosslinking may be present so long as the polymers are still capable of melting and flow at the pressures utilized.

Non-limiting examples of suitable high temperature thermoplastic polymers include polyamids, high molecular weight polyolefins, polyarylenesulfones, polyarylene oxides, polyarylene sulfides, polyethersulfones, polyetherketones, polyimides, polyetherimides, polycarbonates, polyoxymethylenes, polyesters, and the like.

The polyamids are particularly useful, particularly the liquid crystalline polyamids and aramids. Polyamids with melting points in the range of 200° to 300° C., i.e. polyamide 66, may be useful at the lower end of the extreme lubricant range, and under far more strenuous conditions than polyethylene waxes and the like. However, extension of the processing parameters of the subject lubricants to extreme conditions requires use of liquid crystalline polyamids, aramids, or other high melting polyamids. Preferably, the polyamids have a melt temperature of 300° C. or greater, preferably 350° C. or greater. Aramides such as Nomex® and Kevlar® have high melt temperatures ($T_m$), for example in the range of 365° C. to 500° C. Such polyamids are commercially available.

High temperature polyolefins are also useful, for example those having a $T_m$ greater than 250° C. Unlike polyethylene waxes which are oligomeric and often contain additional comonomers to further lower melting points, high temperature polyolefins are prepared using catalyst systems which encourage high molecular weight and structural uniformity which causes these polymers to have high melting points. Ultra high molecular weight polyethylene and polypropylene, particularly polypropylene having a high degree of isotacticity may be suitable. However, in particular, polymers of cyclohexene, of cyclopentene, of norbornene, and the like, optionally substituted with alkyl groups are suitable, as well as their copolymers. Such polymers are commercially available. For example, isotactic poly(3-methyl-1-butane) isotactic poly(4-methyl-1-pentene) have melting points ($T_m$) of 310° C. and 240° C., respectively.

Polyarylenesulfones, polyether ketones, and polycarbonates are characterized by the repeating structure:

$$\left[\phi\text{-X-}\phi\text{-Y}\right]_n$$

where each $\phi$ represents the same or a different aryl moiety such as, but not limited to, substituted and unsubstituted phenyl, biphenyl, naphthyl, diphenylether, diphenylmethane, and diphenylisopropylidene, wherein the preferred substituents are $C_{1-4}$ alkyl groups, and wherein X and Y are the same or different, and represent —O—,—S—, —SO—, —$SO_2$—1 —CO—, O—CO—O, and the like. Such thermoplastics are readily available commercially.

Also useful are polyesters. Polyesters are derived from the condensation esterification of a diacid and a glycol. Both conventional and liquid crystalline polyesters are useful. Examples of polyesters are high molecular weight polyethyleneadipates, polybuthyleneadipates, polyethyleneterephthalates ($T_m$=245° C.), polybutyleneterephthalates, polycyclohexanedimethyleneterephthalates, etc. Once again, such polyesters are commercially available.

Polyimides and polyetherimides are further useful. Examples of polyimides are Kapton® and Lenzing 2080. An example of a suitable polyetherimide is Ultem®, a product of General Electric.

The high temperature thermoplastic must be utilized in finely divided form such that a stable dispersion results. Such dispersions are preferably resistant to sedimentation of solid components for at least several days without agitation. The polymers may be supplied in the form of fibers or yarns which are chopped into relatively low aspect fibers, i.e. fibers having an aspect ratio (length:diameter) of from about 10:1 to about 1:10. The finer the diameter of the fiber, the higher the aspect ratio which can be tolerated. For example, with micron or submicron sized fibers, aspect ratios as high or higher than 20–100:1 may be tolerated. Recently, a special form of fibrous Kevlar® polyaramid fiber has been developed which is highly suitable. These fibers, known as Kevlar® 1F543, but not limited to, have been touted for use as thickeners and thixotrophy agents, and have numerous microfiber tendrils off the principle fibers which gives them a particularly high surface ratio.

The high temperature thermoplastic polymers may also be used in finely divided form produced by such techniques as gas jet milling, sand milling, cryogenic grinding, spray drying, solution precipitation, and the like. For example, a particular polymer may be dissolved in a strong, aprotic, water miscible solvent such as N-methylpyrollidone, dimethylsulfoxide, dimethylacetamide, or dimethylformamide and poured into water, or another non-solvent with which the aprotic solvent is miscible, under high sheer agitation to produce generally spherical or elongate microparticles of polymer. Particle sizes of 0.05 $\mu$m to 50 $\mu$m, preferably 0.1 $\mu$m to 10 $\mu$m are preferred.

The high temperature thermoplastic may be present in amounts ranging from about 0.1 weight percent to about 20 weight percent based on the weight of non-volatile ingredients, preferably from about 1 weight percent to about 10 weight percent. Higher percentages may be useful when two or more high temperature thermoplastic polymers spanning two temperature ranges are used. For example, the difference in $T_m$ of two high temperature thermoplastics may be 50° C. or more, preferably 100° C. The organic phosphate ester lubricant may be present in an amount from about 0.4 weight percent to about 20 weight percent. For example, an extended range lubricant composition may have low temperature/pressure lubricants such as triisopropylamine and MASLIP® 504 phosphate ester; a moderate temperature pressure lubricant such as SLIP-AYD® 630, a polyethylene wax dispersion available from S.C. Johnson, an extreme condition, high temperature/pressure lubricant of nylon 44 or nylon 46 particles or fibers, and an extreme condition very high temperature/pressure lubricant of Kevlar® fibrils.

In the film forming compositions of the subject invention, the ingredients contain a film forming polymer. The film forming polymer is one which is soluble or dispersible in the remaining ingredients, which preferably forms a substantially non-tacky film when dry, the film being relatively hard. Suitable film forming polymers are well known and include various polyacrylates, polyvinylacrylates, styrene-acrylic copolymers, polyurethanes, and the like. An example of a suitable film forming polymer is JONCRYLO® 678 acrylic resin, a product of S.C. Johnson & Son, believed to contain 1–3 weight percent diethylene glycol monoethyl ether and a styrene-acrylic copolymer. JONCRYL® 678 is nominally a solid in the form of clear flakes, has an acid value of 200, a density of 1.25 $glcn^3$, and a number average molecular weight of c.a. 8000. However, the particular film forming polymer is not overly critical. The film forming polymer may advantageously be used in an amount from 2.5 to about 35 weight percent.

The film, as indicated, is preferably substantially non-tacky. By "substantially non-tacky" means that the degree of tackiness or adhesiveness felt by a touch is small. However, some tackiness can be tolerated, particularly if the lubricant is to be applied to the workpiece in the same building and can be shielded from dust or dirt pickup. Under these conditions, even relatively tacky, or "sticky" films, may be used. However, in many cases, workpieces are coated at a distant location and shipped. Under these conditions, a low degree of tack is desired. The film should also be relatively hard so that it is not easily scratched, abraded, or removed during routine handling. Those skilled in the art readily understand the meanings of the terms "tack," "substantially tack free," "hard" in relation to the film hardness, and the like.

If use of the lubricant of the subject invention in a liquid state can be tolerated, then the film forming polymer or a portion of it may be eliminated from the formulation. However, in such cases, it may be advisable to introduce a soluble polymeric thickener, for example a standard polyacrylic acid thickener or an associative thickener such as those disclosed in U.S. Pat. Nos. 4,709,099; 4,673,518; 4,665,239; 4,649,224; and 4,354,956 in order to increase the viscosity to aid in applying and maintaining the coating. For example, it may be desirable to utilize a lubricant which has the composition of a cream or gel, or is thixotropic. Further, enough film forming polymer or an equivalent is necessary to act as a sticking agent to promote adhesive of the lubricant composition to the workpiece. Further ingredients including anti-corrosion agents, other pressure reducing additives, and lubricity aids such as those disclosed in U.S. Pat. Nos 4,390,439; 4,493,780; 4,626,366; and 4,797,299, which are herein incorporated by reference.

Having generally described this invention, a further understanding can be obtained by reference to certain specific examples which are provided herein for purposes of illustration only and are not intended to be limiting unless otherwise specified.

EXAMPLE 1

A film-forming metal working lubricant composition is prepared by thoroughly mixing the following ingredients until a uniform, stable dispersion results.

KCM 0101 PUS

| | Ingredient | Parts by Weight |
|---|---|---|
| 1. | SLIP-AYD ® SL 630 | 62 |
| 2. | JONCRYL ® 537 | 24 |
| 3. | MASLIP ® 504 | 3.6 |
| 4. | AGROSOL OT 75 | 0.5 |
| 5. | Triisopropanolamine | 0.5 |
| 6. | BYK 032 | 0.24 |
| 7. | Water | 8.8 |
| 8. | High Temperature Polymer Lubricant (Kevlar ® and/or SPECTRA ® Fibers) | 0.1 to 20 |

Ingredient 3 was sheared into ingredient 2 until a homogenous mixture resulted. Ingredients 4, 5, and 6 were blended together with mild agitation (hand mixing), following which ingredient 7 is added. The admixture of ingredients 4–7 is then sheared with the admixture of 2 and 3 until homogenous. Ingredient 8 is blended with ingredient 1, following which this blend is mixed with gentle agitation with the preceding ingredients.

The amount of high temperature polymer is dependent upon the end use, with higher amounts, i.e. 5% by weight to 10% by weight or more suitable for cold forging while lower amounts, i.e. 0.1 to 50, are suitable for drawing and stamping operations.

A formulation as above, and containing 0.5–40% by weight Kevlar® 1F542 fibers is compared to a similar product not containing Kevlar®. The Kevlar® formulation produced a superior product. The formulation compared to a teflon-containing lubricant is superior as the teflon-containing lubricant forms a gummy coating on the die after several uses.

Having now fully described the invention, it will be apparent to one of ordinary skill in the art that many changes and modifications can be made thereto without departing from the spirit or scope of the invention as set forth herein.

What is claimed is:

1. An aqueous metal working lubricant composition suitable for extreme condition lubrication in metal forming operations, comprising:

an organic phosphate ester lubricant; and dispersed therein one or more finely divided, high melt temperature, substantially halogen-free thermoplastics having a $T_m$ of about 200° C. or greater, said aqueous metal lubricant composition being borate-free.

2. The lubricant of claim 1 wherein said high melt temperature thermoplastic has a $T_m$ greater than about 300° C.

3. The lubricant of claim 1 wherein said high melt temperature thermoplastic has a $T_m$ greater than about 400° C.

4. The lubricant of claim 1 comprising at least two high melt temperature, substantially halogen-free thermoplastics differing in $T_m$ by at least 50° C.

5. The lubricant of claim 1 comprising at least two high melt temperature, substantially halogen-free thermoplastics differing in $T_m$ by at least 100° C.

6. The composition of claim 1 which further comprises a film forming polymer which dries to form a non-tacky film upon drying of said composition.

7. The composition of claim 1 wherein at least one of said one or more high melt temperature, substantially halogen-free thermoplastics is selected from the group consisting of an aramid having a $T_m$ of greater than 350° C. and a polyolefin having a $T_m$ greater than 250° C.

8. An aqueous metal working forming lubricant composition, comprising water, an organic phosphate ester, one or more dispersion stabilizing surfactants, a dispersion of a natural or synthetic wax, and a high temperature lubricant consisting of one or more finely divided substantially non-halogenated thermoplastics having a melting point in excess of 250° C.

9. In a process for the forming of metal articles in dies suitable therefore, wherein a metal, prior to forming, is first coated with a metal forming lubricant, the improvement comprising coating said metal article with an aqueous metal forming lubricant substantially free of borates, said metal forming lubricant comprising, in addition to water, a) an organic phosphate ester;

b) a dispersion of a natural or synthetic wax;

c) optionally a film forming polymer; and d) a high temperature, high pressure lubricant consisting of one or more finely divided substantially non-halogenated thermoplastics having a melt temperature above 200 C.

10. The process of claim 9 wherein said metal forming lubricant contains a film forming polymer, and wherein after coating said metal with said metal forming lubricant and prior to forming, said coating of metal forming lubricant is dried to form a tack free lubricant coating.

11. The process of claim 9 wherein said organic phosphate is a polyoxyalkylene phosphate ester.

12. The process of claim 9 wherein said high temperature, high pressure lubricant is a thermoplastic selected from the group consisting of polyamides, polyolefins, polyarylenesulfones, polyaryleneoxides, polyarylenesulfides, polyethersulfones, polyetherketones, polyimides, polyetherimides, polycarbonates, polyoxymethylenes, polyesters, and mixtures thereof.

13. The process of claim 12 wherein said high temperature, high pressure lubricant consists of two or more thermoplastics at least two of which differ in $T_m$ by at least 50° C.

14. The aqueous metal working lubricant composition of claim 1, wherein said organic phosphate ester comprises a polyoxyalkylene phosphate ester in an amount of from about 0.4 weight percent to about 20 weight percent; wherein at least one of said high melt temperature, substantially halogen-free thermoplastics has a melt temperature greater than 250° C. and is present in an amount of from about 0.1 weight percent to about 20 weight percent, and wherein said aqueous metal working lubricant composition further comprises:

a) from about 2.5 weight percent to about 35 weight percent of a natural or synthetic wax having a melting point of about 125° C. or below;

b) from about 2.5 weight percent to about 35 weight percent of a film forming polymer; and c) up to about 20 weight percent of one or more dispersion-stabilizing and coalescence-promoting surfactants, all weight percents being based upon the total weight of said aqueous metal working lubricant composition.

15. An aqueous metal working lubricant composition suitable for extreme condition lubrication in metal forming operations, comprising:

an organic phosphate ester lubricant; and dispersed therein one or more finely divided, high melt temperature, substantially halogen-free thermoplastics having a $T_m$ of about 400° C. or greater.

16. An aqueous metal working lubricant composition suitable for extreme condition lubrication in metal forming operations, comprising:

an organic phosphate ester lubricant; and dispersed therein two or more finely divided, high melt temperature, substantially halogen-free thermoplastics having a $T_m$ of about 200° C. or greater, wherein said aqueous metal lubricant comprises at least two high melt temperature, substantially halogen-free thermoplastics differing in $T_m$ by at least 50° C.

17. The aqueous metal working lubricant of claim 16 wherein said at least two high melt temperature, substantially halogen-free thermoplastics differ in $T_m$ by at least 100° C.

18. The composition of claim 16 which further comprises a film forming polymer which dries to form a non-tacky film upon drying of said composition.

19. The aqueous metal working lubricant composition of claim 16, wherein said organic phosphate ester comprises a polyoxyalkylene phosphate ester in an amount of from about 0.4 weight percent to about 20 weight percent; wherein at least one of said high melt temperature, substantially halogen-free thermoplastics has a melt temperature greater than 250° C. and is present in an amount of from about 0.1 weight percent to about 20 weight percent, and wherein said aqueous metal working lubricant composition further comprises:

a) from about 2.5 weight percent to about 35 weight percent of a natural or synthetic wax having a melting point of about 125° C. or below;

b) from about 2.5 weight percent to about 35 weight percent of a film forming polymer; and c) up to about 20 weight percent of one or more dispersion-stabilizing and coalescence-promoting surfactants, all weight percents being based upon the total weight of said aqueous metal working lubricant composition.

* * * * *